US006533379B1

(12) United States Patent
Kubota

(10) Patent No.: US 6,533,379 B1
(45) Date of Patent: Mar. 18, 2003

(54) DRIVING METHOD FOR RECORDING HEAD

(75) Inventor: Atsushi Kubota, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/252,444

(22) Filed: Feb. 18, 1999

(30) Foreign Application Priority Data

Feb. 26, 1998 (JP) ..... 10-045793

(51) Int. Cl.[7] ..... B41J 2/01
(52) U.S. Cl. ..... 347/12
(58) Field of Search ..... 347/40, 12, 19, 347/41

(56) References Cited

U.S. PATENT DOCUMENTS

| | | | | | |
|---|---|---|---|---|---|
| 4,014,029 | A | * | 3/1977 | Lane et al. | 347/40 |
| 4,345,262 | A | * | 8/1982 | Shirato et al. | 347/57 |
| 5,250,956 | A | | 10/1993 | Haselby et al. | 347/19 |
| 5,644,344 | A | | 7/1997 | Haselby | 347/19 |
| 5,889,537 | A | * | 3/1999 | Shimada | 347/41 |
| 5,929,875 | A | * | 7/1999 | Su et al. | 347/19 |

FOREIGN PATENT DOCUMENTS

| | | | | |
|---|---|---|---|---|
| EP | 0005844 | | 12/1979 | |
| EP | 0425285 | | 5/1991 | |
| EP | 0433556 | | 6/1991 | |
| EP | 0 554 907 | A2 | 8/1993 | |
| EP | 0 595 651 | A2 | 5/1994 | |
| EP | 0 595 657 | A2 | 5/1994 | |
| JP | 62077951 | * | 4/1987 | 347/19 |
| JP | 7-156452 | | 6/1995 | |
| WO | WO 96/32281 | | 10/1996 | |

OTHER PUBLICATIONS

Patent Abstracts of Japan, vol. 005, No. 166 (M–093), Oct. 23, 1981 and JP 56–092076 A (NEC Corp.), Jul. 25, 1981. –Abstract only–.

* cited by examiner

*Primary Examiner*—Craig Hallacher
*Assistant Examiner*—Julian D. Huffman
(74) *Attorney, Agent, or Firm*—Frishauf, Holtz, Goodman & Chick, P.C.

(57) ABSTRACT

In a method of driving a plurality of ink jet heads, each ink jet head comprises a plurality of ink chambers that are each provided with an ink nozzle. The ink nozzles of each of the ink jet heads are divided into N sets each including every N-th ink nozzle, where N is an integer of two or more, and the N sets of the ink nozzles are arranged in parallel longitudinal rows in a staggered arrangement. The respective ink nozzles in corresponding rows of the ink jet heads are spaced apart from each other by a distance equal to an integral multiple of a pitch of the rows of the ink nozzles in each of the ink jet heads in a sub-scanning direction in which a recording medium is moved, and the ink nozzles eject ink as the ink nozzles move relative to the recording medium in a main scanning direction perpendicular to the sub-scanning direction. The ink nozzles of each of the N sets are driven to eject ink on a same line on the recording medium, by controlling a timing at which the ink nozzles of each set are driven and a relative speed between the ink jet heads and the recording medium. When an amount of misalignment between dots recorded by a reference set of the ink nozzles and dots recorded by another set of the ink nozzles exceeds one-half of a dot pitch defined in the sub-scanning direction, an order in which the sets of ink nozzles are driven is changed to reduce the amount of misalignment between dots to below one-half of the dot pitch defined in the sub-scanning direction.

10 Claims, 11 Drawing Sheets

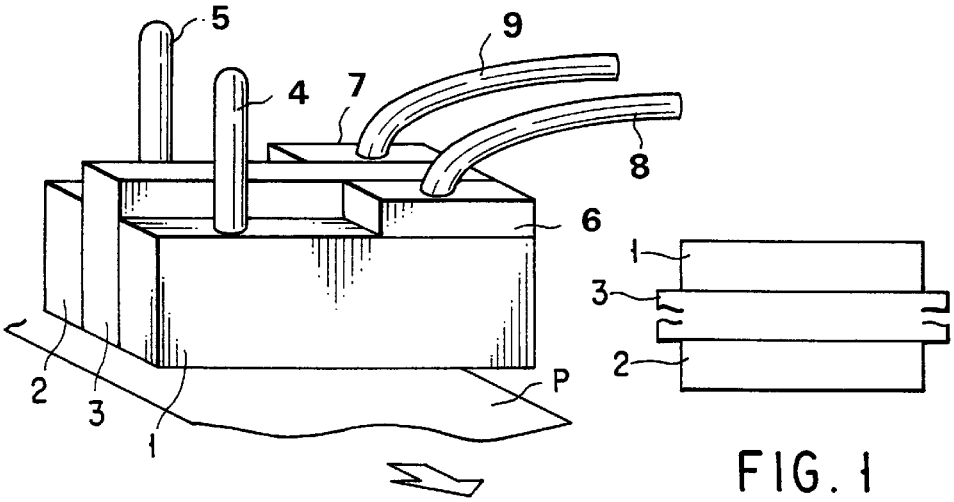
FIG. 1
FIG. 2
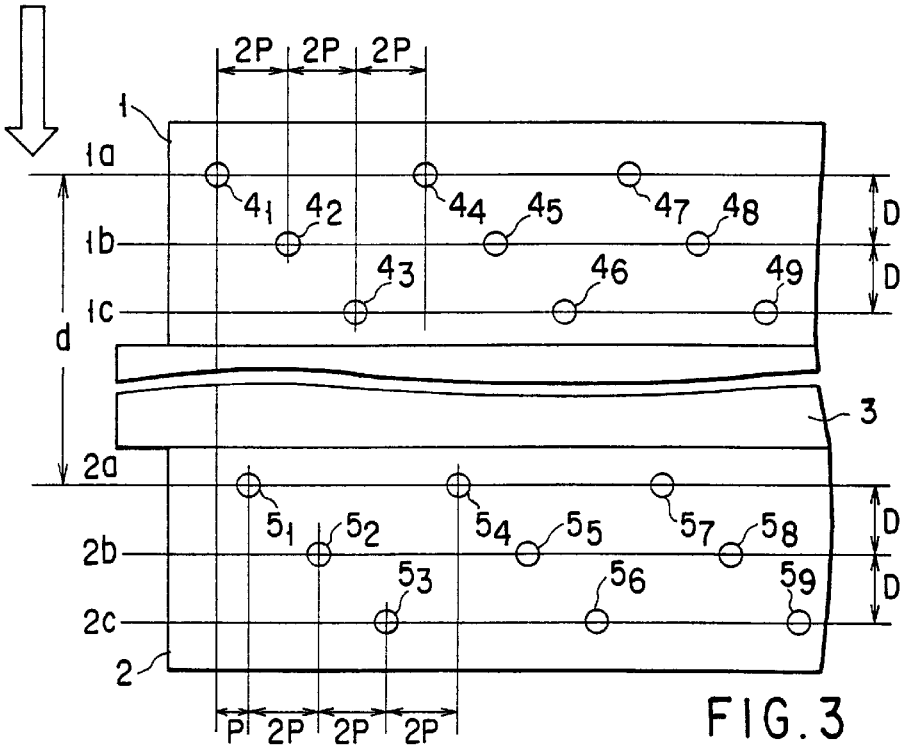
FIG. 3

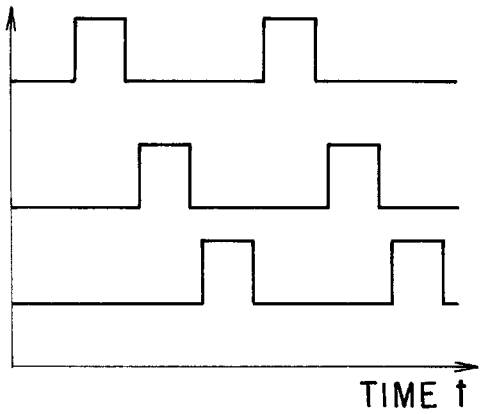
FIG. 4A
FIG. 4B
FIG. 4C
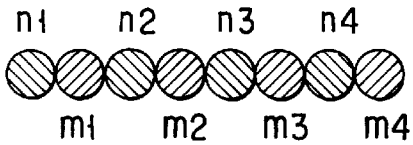
FIG. 5
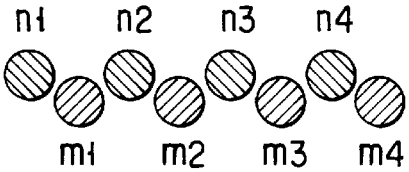
FIG. 6A
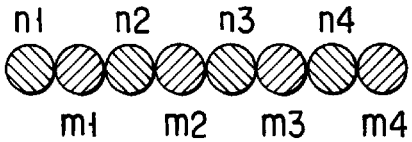
FIG. 6B
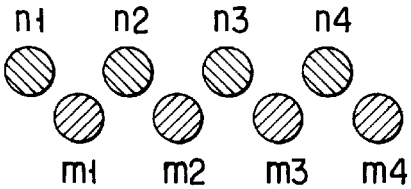
FIG. 7A
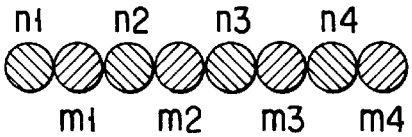
FIG. 7B FIG. 9A
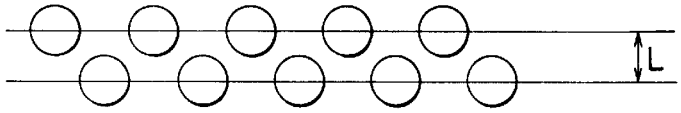
FIG. 9B
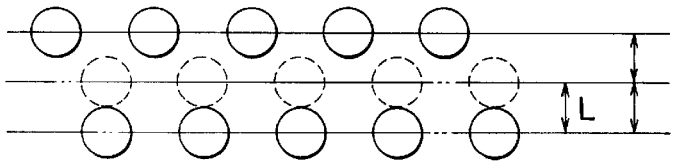
FIG. 11
| | | | | | | | | |
|---|---|---|---|---|---|---|---|---|
| d11 | d12 | d13 | d14 | d15 | d16 | d17 | d18 | -------- |
| d21 | d22 | d23 | d24 | d25 | d26 | -------- | | |
| d31 | d32 | d33 | d34 | d35 | d36 | -------- | | |
| d41 | d42 | d43 | d44 | d45 | d46 | -------- | | |
| d51 | d52 | d53 | d54 | d55 | d56 | -------- | | |
| ⋮ | ⋮ | ⋮ | ⋮ | ⋮ | ⋮ | | | |
FIG. 12A
FIG. 12B
FIG. 12C
FIG. 12D
FIG. 12E
FIG. 12F
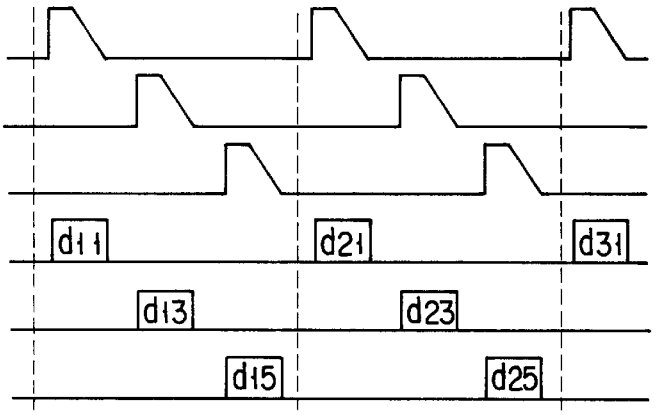

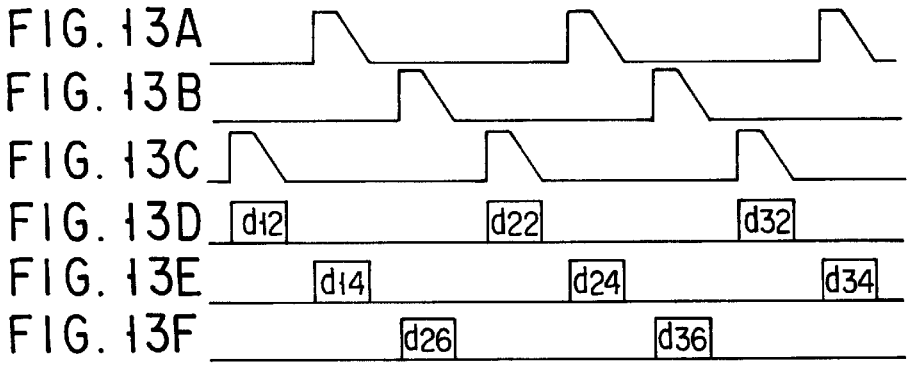
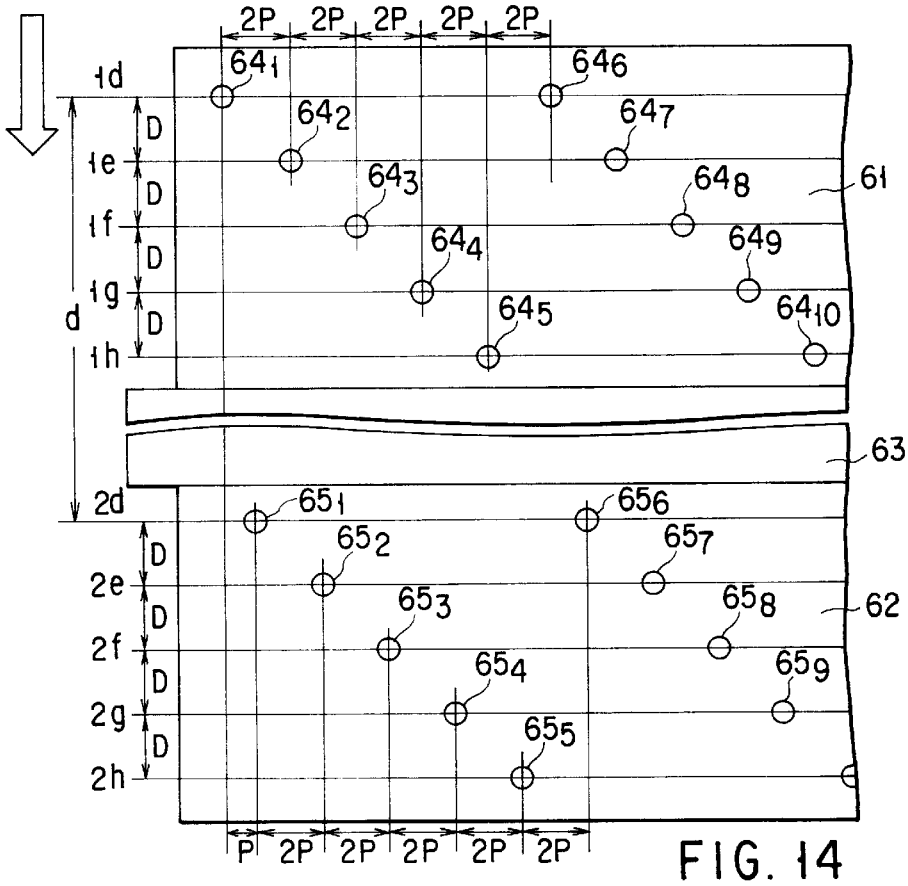
FIG. 14

FIG. 15A
FIG. 15B
FIG. 15C
FIG. 15D
FIG. 15E
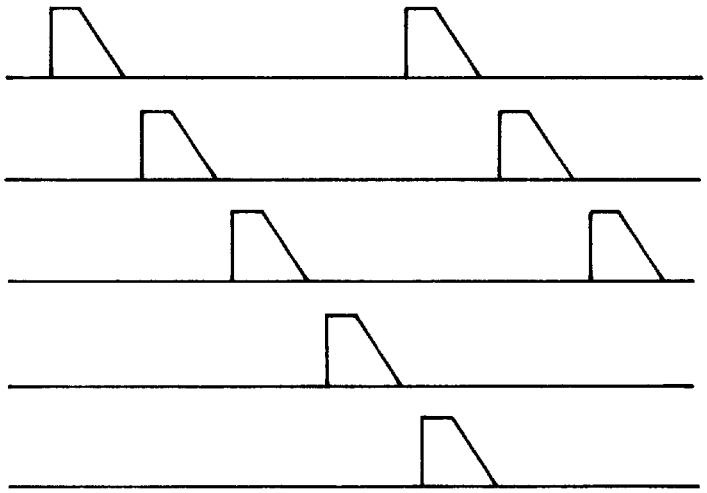
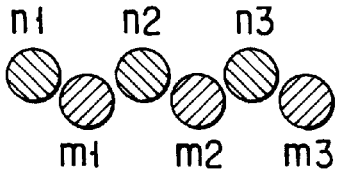
FIG. 16A
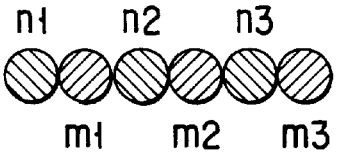
FIG. 16B
FIG. 17
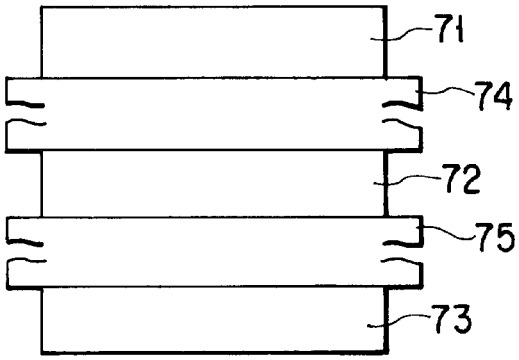

DRIVING METHOD FOR RECORDING HEAD

BACKGROUND OF THE INVENTION

The present invention relates to a method for driving a recording head that is composed of a plurality ink-jet heads.

An example of a printer that uses a recording head composed of a plurality of ink-jet heads is an ink-jet color printer, which is equipped with ink-jet heads each for a respective one of four colors of ink (yellow, cyan, magenta, and black) and drives these heads to provide full-color printing. Such a recording head achieves color printing by superimposing each of colored dots of yellow, cyan, magenta, and black on top of the other and therefore has a requirement for strict control of the distance between each head ink nozzle.

However, for printing with high resolution, it is difficult to set precisely the distance between each head ink nozzle to an integral multiple of the pixel pitch. For example, in the case of printing resolutions of 300 to 600 dpi (dots per inch), the distance between printed dots is of the order of 40 to 80 $\mu$m. In particular, there arises a considerable degradation in image quality, which is due to periodical unevenness of printing resulting from misalignment of dots due to mechanical displacements at the time of mounting each head. This could be solved by increasing the mechanical precision in mounting each head. To this end, great precision would be required of head mounting members and moreover complex and great precision would also be required for mounting adjustment, making the manufacture difficult and increasing the manufacturing cost.

A method is also known which solves the misalignment of printed dots by displacing the printing timing according to the pitch corresponding to a mounting error between each ink jet head. For example, the misalignment of printed dots in the sub-scanning direction in which a printing medium travels can be corrected by providing a plurality of clocks that permit the printing initiation timing to be selected for each ink jet head and selecting the printing initiation timing according to the displacements of the printing pitch. For example, the provision of a clock four times the normal printing period allows for electrical correction of up to ¼ pitch of displacement in the sub-scanning direction.

Moreover, a method is known which corrects printing positions by providing a delay circuit for a position displacement for each printing line and displacing the printing timing through the delay circuit. Furthermore, as described in Japanese Unexamined Patent Publication No. 7-156452, a method is also known which utilizes a buffer memory to ensure delay control and high picture quality control.

In summary, the technique that uses a plurality of clocks that allow the printing initiation timing to be selected for each ink jet head requires the clock speed to be increased, which results in complication of control and an increase in cost. The delay circuit-based technique has a problem that control becomes complicated. The techniques disclosed in the patent publication needs a basic clock of N times the highest response frequency for printing and a buffer memory, which complicates control as a result of the increased driving frequency.

BRIEF SUMMARY OF THE INVENTION

It is therefore an object of the present invention to provide a recording head driving method which permits misalignment between printed dot arrangements in both the sub-scanning and main scanning directions through simple control.

According to the present invention, there is provided a method of driving a recording head in which a plurality of ink jet heads each having a large number of ink chambers each provided with an ink nozzle are arranged in parallel with each other in a main scanning direction perpendicular to a direction in which a recording medium moves relative to the heads and are spaced apart from each other by a predetermined distance in a sub-scanning direction in which the recording medium moves, comprising dividing the ink chambers of each of the ink jet heads into N (an integer of two or more) sets each including every N-th ink chamber, placing ink nozzles of N ink chambers each included in a respective one of the N sets in a staggered arrangement, driving the ink chambers on a time division basis for each set, and, when the amount of misalignment between dots recorded by droplets of ink ejected from ink nozzles of a set of ink chambers in a reference head of the heads and dots recorded by droplets of ink ejected from ink nozzles of each set of ink chambers in the other heads than the reference head exceeds one-half of a dot pitch in the sub-scanning direction, changing the order in which the sets of ink chambers are driven on a time division basis to reduce the amount of misalignment of dots below one-half of the dot pitch in the sub-scanning direction.

This method allows alignment error between printed dots in the sub-scanning direction to be corrected through simple control.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a schematic representation of a print head assembly according to a first embodiment of the present invention;

FIG. 2 is a perspective view of the print head assembly shown in FIG. 1;

FIG. 3 shows an arrangement of ink nozzles of each ink jet head in the first embodiment;

FIGS. 4A, 4B and 4C show drive voltage waveforms used in the first embodiment;

FIG. 5 shows printed dots by the ink jet heads in the first embodiment;

FIGS. 6A and 6B show printed dots in the first embodiment before and after correction of alignment error;

FIGS. 7A and 7B show printed dots in the first embodiment before and after correction of alignment error;

FIGS. 9A and 9B are diagrams for use in explanation of methods of measuring the amount L of misalignment between dot arrangements in the first embodiment;

FIG. 11 shows an arrangement of printed dot data in the second embodiment;

FIGS. 12A through 12F show a relationship between driving timing and printed dot data in the second embodiment;

FIGS. 13A through 13F show another relationship between driving timing and printed dot data in the second embodiment;

FIG. 14 shows an arrangement of ink nozzles of each ink jet head in a third embodiment of the present invention;

FIGS. 15A through 15E show drive voltage waveforms used in the third embodiment;

FIGS. 16A and 16B show printed dots in the third embodiment before and after correction of dot alignment error;

FIG. 17 is a schematic representation of a print head assembly according to a fourth embodiment of the present invention;

DETAILED DESCRIPTION OF THE INVENTION

Figure 8:
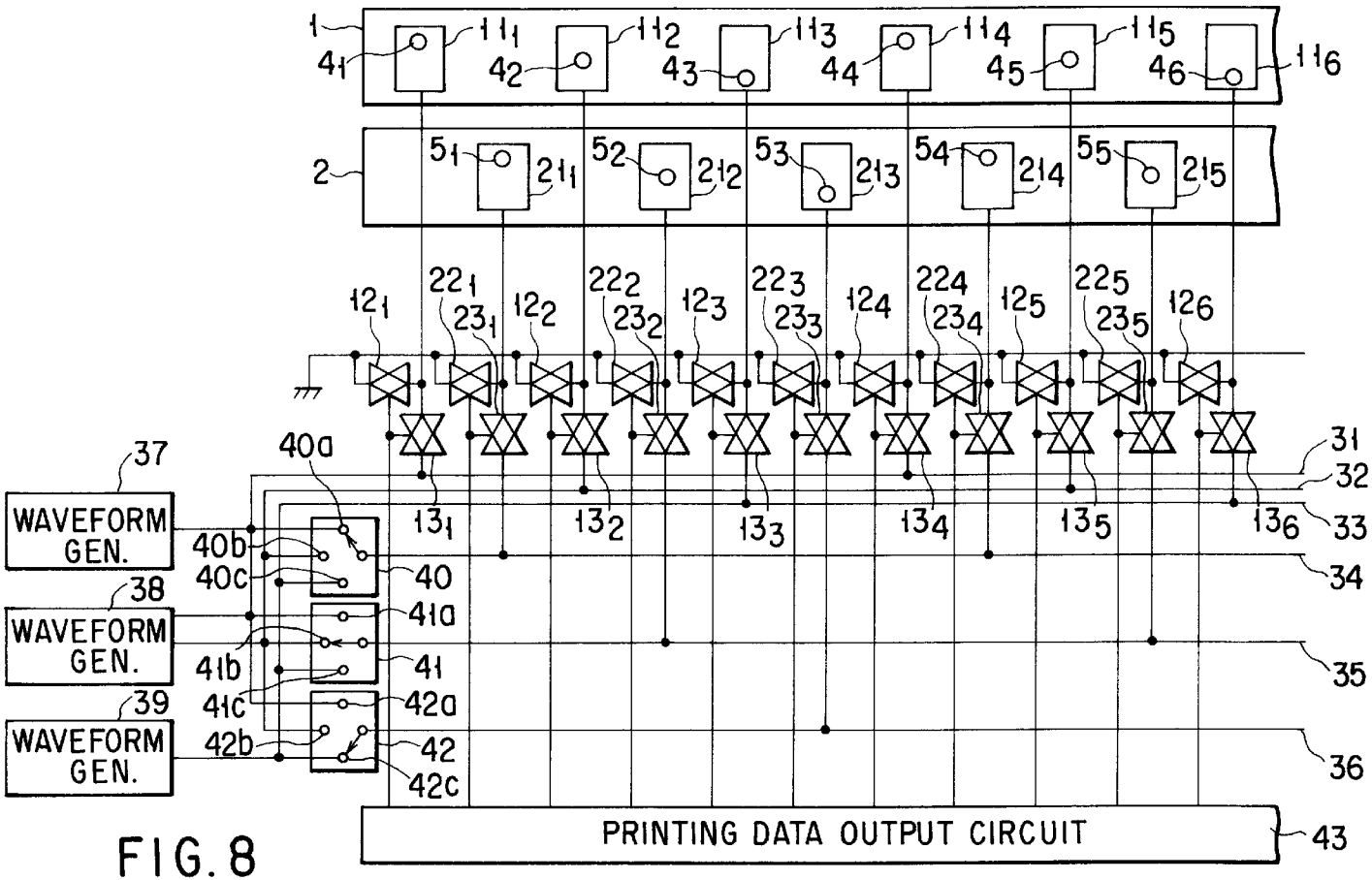
FIG. 8 shows an ink jet head driver circuit in the first embodiment.

As shown in FIG. 1, ink jet heads 1 and 2, each with a large number of ink chambers, are fixed with adhesive to both sides of a substrate 3 which are parallel to each other to thereby form one recording head assembly.

The ink jet heads 1 and 2 and the substrate 3 are of such configuration as show in FIG. 2.

That is, the ink jet heads 1 and 2 each with a large number of ink chambers are fixed to the respective sides of the substrate 3.

Ink supply tubes 4 and 5 are connected to the ink jet heads 1 and 2, respectively.

To portions of the ink jet heads 1 and 2 are respectively mounted connectors 6 and 7 with which cables 8 and 9 are connected respectively. Through these cables the ink jet heads 1 and 2 are supplied with drive voltages. P denotes a sheet of paper as a recording medium.

As shown in FIG. 3, the ink jet heads 1 and 2 are formed with ink nozzles $\mathbf{4}_1$ to $\mathbf{4}_9$, . . . and $\mathbf{5}_1$ to $\mathbf{5}_9$, . . . each corresponding to a respective one of the ink chambers. These ink nozzles are placed in a staggered arrangement for every three nozzles. That is, these ink nozzles $\mathbf{4}_1$ to $\mathbf{4}_9$, . . . of the ink jet head 1 are arranged at regular intervals of pitch 2P in the main scanning direction perpendicular to the direction of movement of the recording medium indicated by an arrow.

In the ink jet head 1, the ink chambers are divided into three sets each including every third head. That is, the ink nozzles $\mathbf{4}_1$, $\mathbf{4}_4$, $\mathbf{4}_7$, etc. form a first set. The nozzles $\mathbf{4}_2$, $\mathbf{4}_5$, $\mathbf{4}_8$, etc. form a second set, and the nozzles $\mathbf{4}_3$, $\mathbf{4}_6$, $\mathbf{4}_9$, etc. form a third set. The ink nozzles $\mathbf{4}_1$, $\mathbf{4}_4$, $\mathbf{4}_7$, etc. in the first set to which reference is made are arranged on a line 1*a*. The ink nozzles $\mathbf{4}_2$, $\mathbf{4}_5$, $\mathbf{4}_8$, etc. in the second set are arranged on a line 1*b* which is offset from the line 1*a* by given pitch D in the sub-scanning direction in which the recording medium travels. The ink nozzles $\mathbf{4}_3$, $\mathbf{4}_6$, $\mathbf{4}_9$, etc. in the third set are arranged on a line 1*c* which is offset from the line 1*b* by the pitch D in the sub-scanning direction.

In the ink jet head 2 as well, the ink chambers are divided into three sets each including every third head. That is, the ink nozzles $\mathbf{5}_1$, $\mathbf{5}_4$, $\mathbf{5}_7$, etc. form a first set. The nozzles $\mathbf{5}_2$, $\mathbf{5}_5$, $\mathbf{5}_8$, etc. form a second set, and the nozzles $\mathbf{5}_3$, $\mathbf{5}_6$, $\mathbf{5}_9$, etc. form a third set.

Each of the nozzles $\mathbf{5}_1$ to $\mathbf{5}_9$, etc. in the ink jet header 2, which are arranged at regular intervals of pitch 2P in the main scanning direction, is offset from a corresponding one of the nozzles $\mathbf{4}_1$ to $\mathbf{4}_9$, etc. by pitch P in the main scanning direction. The ink nozzles $\mathbf{5}_1$, $\mathbf{5}_4$, $\mathbf{5}_7$, etc. in the first set are arranged on a line 2*a* which is spaced apart from the reference line 1*a* by distance d in the sub-scanning direction. The ink nozzles $\mathbf{5}_1$, $\mathbf{5}_4$, $\mathbf{5}_7$, etc. in the second set are arranged on a line 2*b* which is offset from the line 2*a* by given pitch D in the sub-scanning direction. The ink nozzles $\mathbf{5}_3$, $\mathbf{5}_6$, $\mathbf{5}_9$, etc. in the third set are arranged on a line 2*c* which is offset from the line 2*b* by the pitch D in the sub-scanning direction.

The ink jet heads 1 and 2 are each arranged to provide drive voltage waveforms to their respective ink chambers at the times indicated in FIGS. 4A, 4B and 4C, thus performing three-phase driving. That is, the ink jet head 1 allows the ink nozzles $\mathbf{4}_1$, $\mathbf{4}_4$, $\mathbf{4}_7$, etc. on the line 1*a* to project droplets of ink at the time shown in FIG. 4A, the nozzles $\mathbf{4}_2$, $\mathbf{4}_5$, $\mathbf{4}_8$, etc. on the line 1*b* to project droplets of ink at the time shown in FIG. 4B, and the nozzles $\mathbf{4}_3$, $\mathbf{4}_6$, $\mathbf{4}_9$, etc. on the line 1*c* to project droplets of ink at the time shown in FIG. 4C. The ink jet head 2 allows the ink nozzles $\mathbf{5}_1$, $\mathbf{5}_4$, $\mathbf{5}_7$, etc. on the line 2*a* to project droplets of ink at the time shown in FIG. 4A, the nozzles $\mathbf{5}_2$, $\mathbf{5}_5$, $\mathbf{5}_8$, etc. on the line 2*b* to project droplets of ink at the time shown in FIG. 4B, and the nozzles $\mathbf{5}_3$, $\mathbf{5}_6$, $\mathbf{5}_9$, etc. on the line 2*c* to project droplets of ink at the time shown in FIG. 4C.

Thus, when a line of printing is made with the recording head, the ink jet head 1 first prints dots n1, n2, n3, n4, . . . shown in FIG. 5 trough the three-phase driving and the ink jet head 2 then prints dots m1, m2, m3, m4, . . . through the three-phase driving, so that one line can be printed at dot pitch P in the main scanning direction. That is, the ink jet heads 1 and 2, while each having a dot pitch of 2P in the main scanning direction, can make printing at twice the resolution determined by that dot pitch.

If the spacing d between the lines 1*a* and 2*a* of the heads 1 and 2 is set such that d=n×3D (n is a positive integer), then a dot line printed by the head 1 can be superimposed upon a dot line by the head 2 because the timing of application of the drive voltages shown in FIGS. 4A, 4B and 4C are determined based on the pitch D in the sub-scanning direction. In this case, there is no problem. However, in practice misalignment occurs between dot lines by the heads 1 and 2 due to irregularities in the thickness of the substrate 3 and/or the adhesive layer.

The difference (d−n×3D) is classified into the following three ranges:

$$-D/6 \leqq d-n\times 3D < D/6 \quad (1)$$

$$D/6 \leqq d-n\times 3D < 3D/6 \quad (2)$$

$$3D/6 \leqq d-n\times 3D < 5D/6 \quad (3)$$

The difference (d−n 3D) in the range defined by (1) is within the normal range of error accepted when dots are printed by the ink jet heads alone. In this case, printing can be made at the predetermined times. However, when the difference is in the range defined by (2) or (3), some corrections are required because it is outside the normal range of error.

For example, when the difference is in the range defined by (2), misalignment takes place between an arrangement of dots n1, n2, n3, n4, . . . printed by the head 1 and an arrangement of dots m1, m2, m3, m4, . . . printed by the head 2 as shown in FIG. 6A.

To eliminate this misalignment, the ink projecting operation of the ink nozzles $\mathbf{4}_1$, $\mathbf{4}_4$, $\mathbf{4}_7$, etc. on the line 1*a* of the head 1 and the ink nozzles $\mathbf{5}_2$, $\mathbf{5}_5$, $\mathbf{5}_8$, etc. on the line 2*b* of the head 2 is performed at the time shown in FIG. 4A, the ink projecting operation of the ink nozzles $\mathbf{4}_2$, $\mathbf{4}_5$, $\mathbf{4}_8$, etc. on the line 1*b* of the head 1 and the ink nozzles $\mathbf{5}_3$, $\mathbf{5}_6$, $\mathbf{5}_9$, etc. on the line 2*c* of the head 2 is performed at the time shown in FIG. 4B, and the ink projecting operation of the ink nozzles $\mathbf{4}_3$, $\mathbf{4}_6$, $\mathbf{4}_9$, etc. on the line 1*c* of the head 1 and the ink nozzles $\mathbf{5}_1$, $\mathbf{5}_4$, $\mathbf{5}_7$, etc. on the line 2*a* of the head 2 is performed at the time shown in FIG. 4C. That is, the timing of projecting of ink from the ink nozzles on the respective lines 2*a*, 2*b* and 2*c* of the ink jet head 2 is changed. By such control, the misalignment between the arrangement of dots n1, n2, n3, n4, etc. and the arrangement of dots m1, m2, m3, m4, etc. is corrected for as shown in FIG. 6B.

When the difference is in the range defined by (3), greater misalignment takes place between the arrangement of dots n1, n2, n3, n4, . . . printed by the head 1 and the arrangement of dots m1, m2, m3, m4, . . . printed by the head 2 as shown in FIG. 7A.

To eliminate such misalignment, the ink projecting operation of the ink nozzles $\mathbf{4}_1$, $\mathbf{4}_4$, $\mathbf{4}_7$, etc. on the line 1*a* of the head 1 and the ink nozzles $\mathbf{5}_3$, $\mathbf{5}_6$, $\mathbf{5}_9$, etc. on the line 2*c* of the head 2 is performed at the time shown in FIG. 4A, the ink projecting operation of the ink nozzles $\mathbf{4}_2$, $\mathbf{4}_5$, $\mathbf{4}_8$, etc. on the line 1*b* of the head 1 and the ink nozzles $\mathbf{5}_1$, $\mathbf{5}_4$, $\mathbf{5}_7$, etc. on the line 2*a* of the head 2 is performed at the time shown in FIG. 4B, and the ink projecting operation of the ink nozzles $\mathbf{4}_3$, $\mathbf{4}_6$, $\mathbf{4}_9$, etc. on the line 1*c* of the head 1 and the ink nozzles $\mathbf{5}_2$, $\mathbf{5}_5$, $\mathbf{5}_8$, etc. on the line 2*b* of the head 2 is performed at the time shown in FIG. 4C. That is, the timing of projecting of ink from the ink nozzles on the respective lines 2*a*, 2*b* and 2*c* of the ink jet head 2 is changed. By such control, the misalignment between the arrangement of dots n1, n2, n3, n4, etc. and the arrangement of dots m1, m2, m3, m4, etc. is corrected for as shown in FIG. 7B.

A head driving method that allows the timing of the projecting of ink to be changed in the manner described above can be implemented by a drive circuit shown in FIG. 8.

In this drive circuit, electrodes for applying voltages to ink chambers $\mathbf{11}_1$, $\mathbf{11}_2$, $\mathbf{11}_3$, $\mathbf{11}_4$, $\mathbf{11}_5$, $\mathbf{11}_6$, . . . in the ink jet head 1 are connected to ground through analog switches $\mathbf{12}_1$, $\mathbf{12}_2$, $\mathbf{12}_3$ $\mathbf{12}_4$, $\mathbf{12}_5$, $\mathbf{12}_6$, . . . , respectively. The electrodes for applying voltages to the ink chambers $\mathbf{11}_1$, $\mathbf{11}_4$, . . . equipped with the ink nozzles $\mathbf{4}_1$, $\mathbf{4}_4$, . . . arranged on the line 1*a* of the ink jet head 1 are connected to a line 31 through analog switches $\mathbf{13}_1$, $\mathbf{13}_4$, . . . respectively. The electrodes for applying voltages to the ink chambers $\mathbf{11}_2$, $\mathbf{11}_5$, . . . equipped with the ink nozzles $\mathbf{4}_2$, $\mathbf{4}_5$, . . . arranged on the line 1*b* of the ink jet head 1 are connected to a line 31 through analog switches $\mathbf{13}_2$ $\mathbf{13}_5$, . . . , respectively. The electrodes for applying voltages to the ink chambers $\mathbf{11}_3$, $\mathbf{11}_6$, . . . equipped with the ink nozzles $\mathbf{4}_3$, $\mathbf{4}_6$, . . . arranged on the line 1*c* of the ink jet head 1 are connected to a line 33 through analog switches $\mathbf{13}_3$, $\mathbf{13}_6$, . . . , respectively.

Electrodes for applying voltages to ink chambers $\mathbf{21}_1$, $\mathbf{21}_2$, $\mathbf{21}_3$, $\mathbf{21}_4$, $\mathbf{21}_5$, . . . in the ink jet head 2 are connected to ground through analog switches $\mathbf{22}_1$, $\mathbf{22}_2$, $\mathbf{22}_3$, $\mathbf{22}_4$, $\mathbf{22}_5$, . . . , respectively. The electrodes for applying voltages to the ink chambers $\mathbf{21}_1$, $\mathbf{21}_4$, . . . equipped with the ink nozzles $\mathbf{5}_1$, $\mathbf{5}_4$, . . . arranged on the line 2*a*of the ink jet head 2 are connected to a line 34 through analog switches $\mathbf{23}_1$, $\mathbf{23}_4$, . . . , respectively. The electrodes for applying voltages to the ink chambers $\mathbf{21}_2$, $\mathbf{21}_5$, . . . equipped with the ink nozzles $\mathbf{5}_2$, $\mathbf{5}_5$, . . . arranged on the line 2*b* of the ink jet head 2 are connected to a line 35 through analog switches $\mathbf{23}_2$, $\mathbf{23}_5$, respectively. The electrodes for applying voltages to the ink chambers $\mathbf{21}_3$, . . . equipped with the ink nozzles $\mathbf{5}_3$, . . . arranged on the line 2*c* of the ink jet head 2 are connected to a line 36 through analog switches $\mathbf{23}_3$, . . . , respectively.

The line 31 is connected to a waveform generator 37 for generating the drive voltage waveform shown in FIG. 4A and to each of first terminals 40*a*, 41*a* and 42*a* of selectors 40, 41 and 42. The line 32 is connected to a waveform generator 38 for generating the drive voltage waveform shown in FIG. 4B and to each of second terminals 40*b*, 41*b* and 42*b* of the selectors 40, 41 and 42. The line 33 is connected to a waveform generator 39 for generating the drive voltage waveform shown in FIG. 4C and to each of third terminals 40*c*, 41*c* and 42*c* of the selectors 40, 41 and 42.

The line 34 is connected to the common terminal of the selector 40. The line 35 is connected to the common terminal of the selector 41. The line 36 is connected to the common terminal of the selector 42.

Based on data to be printed from a printing data output circuit 43, the head drive circuit selectively turns on the analog switches $\mathbf{12}_1$ to $\mathbf{12}_6$ or $\mathbf{22}_1$ to $\mathbf{22}_5$ to thereby connect the electrodes of the ink chambers associated with the selectively turned-on analog switches to ground. Alternatively, the head drive circuit selectively turns on the analog switches $\mathbf{13}_1$ to $\mathbf{13}_6$ or $\mathbf{23}_1$ to $\mathbf{23}_5$ to thereby selectively apply the drive voltage waveform shown in FIG. 4A, 4B or 4C to each of the electrodes of the ink chambers associated with the selectively turned-on analog switches. When the analog switches $\mathbf{13}_1$ to $\mathbf{13}_5$ or $\mathbf{23}_1$ to $\mathbf{23}_5$ are selectively driven, droplets of ink are projected from the nozzles of the corresponding ink chambers.

The selective application of the drive voltage waveform in FIG. 4A, 4B or 4C to each of the ink chamber electrodes is performed through the selectors 40, 41, and 42. That is, when the difference (d−n 3D) is in the range defined by (1), the selector 40 selects the drive voltage waveform from the waveform generator 37 and outputs it onto the line 34. The selector 41 selects the drive voltage waveform from the waveform generator 38 and outputs it onto the line 35. The selector 42 selects the drive voltage waveform from the waveform generator 39 and outputs it onto the line 36.

When the difference (d−n 3D) is in the range defined by (2), the selector 40 selects the drive voltage waveform from the waveform generator 38 and outputs it onto the line 34. The selector 41 selects the drive voltage waveform from the waveform generator 39 and outputs it onto the line 35. The selector 42 selects the drive voltage waveform from the waveform generator 37 and outputs it onto the line 36.

When the difference (d−n 3D) is in the range defined by (3), the selector 40 selects the drive voltage waveform from the waveform generator 39 and outputs it onto the line 34. The selector 41 selects the drive voltage waveform from the waveform generator 37 and outputs it onto the line 35. The selector 42 selects the drive voltage waveform from the waveform generator 38 and outputs it onto the line 36.

Such control allows the alignment error between dot arrangements produced by the ink jet heads 1 and 2 in the sub-scanning direction to be corrected. That is, the dot misalignment in the sub-scanning direction is minimized, allowing high-resolution printing of good quality.

A method of detecting the difference (d−n 3D) involves making printing in a specific pattern for testing as shown in FIG. 9A, observing the result of printing with a microscope, and measuring the spacing L between a line of dots n1, n2, . . . printed by the ink jet head 1 and a line of dots m1, m2, . . . printed by the ink jet head 2.

Alternatively, as shown in FIG. 9B, a testing specific pattern having a constant spacing may be printed and the spacing L between a line of dots m1, m2, . . . and the specific pattern may be determined.

Next, a second embodiment of the present invention will be described with reference to FIGS. 10 through 13. In these figures, like reference numerals are used to denote corresponding parts to those in the first embodiment and only different parts will be described.

Figure 10:
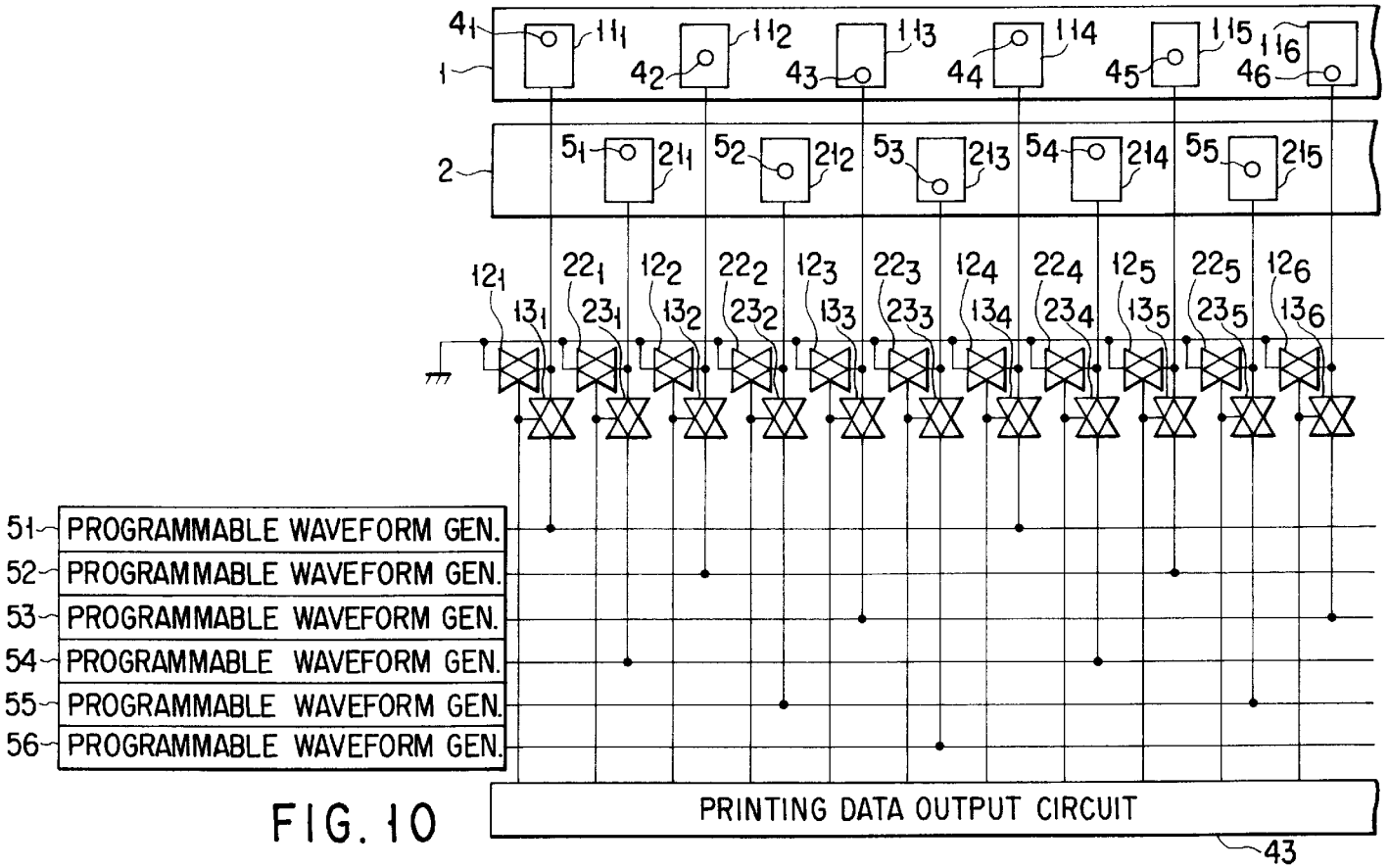
FIG. 10 shows an ink jet head driver circuit in a second embodiment of the present invention.

In the second embodiment, as shown in FIG. 10, the waveform generators 37, 38 and 39 and the selectors 40, 41 and 42 in the first embodiment are replaced with programmable waveform generators 51 to 56. The programmable waveform generator 51 supplies its drive voltage waveform to analog switches $\mathbf{13}_1$, $\mathbf{13}_4$, etc. The programmable waveform generator 52 supplies its drive voltage waveform to the analog switches $\mathbf{13}_2$, $\mathbf{13}_5$, etc. The programmable waveform generator 53 supplies its drive voltage waveform to the analog switches $\mathbf{13}_3$, $\mathbf{13}_6$, etc. The programmable waveform generator 54 supplies its drive voltage waveform to the analog switches $\mathbf{23}_1$, $\mathbf{23}_4$, etc. The programmable waveform generator 55 supplies its drive voltage waveform to the analog switches $\mathbf{23}_2$, $\mathbf{23}_5$, etc. The programmable waveform generator 56 supplies its drive voltage waveform to the analog switches $\mathbf{23}_3$, etc.

In this embodiment, the programmable waveform generators 51 to 56 are set in advance to vary the timing of their respective drive voltage waveform according to the differences (d−n 3D) defined by (1), (2) and (3).

The measurement of the differences is made in the same manner as described in connection with FIGS. 9A and 9B.

FIG. 11 shows an arrangement of printed dot data, in which d11, d21, d31, d41, d51, . . . , d13, d23, d33, d43, d53, . . . , d15, d25, d35, d45, d55, . . . are printed by the ink jet head 1, and d12, d22, d32, d42, d52, . . . , d14, d24, d34, d44, d54, . . . , d16, d26, d36, d46, d56, . . . are printed by the ink jet head 2.

In this printing, when the difference (d−n 3D) between the dot arrangement by the ink jet head 1 and the dot arrangement by the ink jet head 2 in the sub-scanning direction is related by (2), the head 1 drives the ink chambers $\mathbf{11}_1$, $\mathbf{11}_4$, . . . with a drive voltage waveform shown in FIG. 12A, which results in printed dot data d11, d21, d31, . . . as shown in FIG. 12D. The ink chambers $\mathbf{11}_2$, $\mathbf{11}_5$, . . . are driven with a drive voltage waveform shown in FIG. 12B, resulting in printed dot data d13, d23, . . . as shown in FIG. 12E. The ink chambers $\mathbf{11}_3$, $\mathbf{11}_6$, . . . are driven with a drive voltage waveform shown in FIG. 12C, resulting in printed dot data d15, d25, . . . as shown in FIG. 12F.

In contrast, the head 2 drives the ink chambers $\mathbf{21}_2$, $\mathbf{21}_5$, . . . with a drive voltage waveform shown in FIG. 13A, which results in printed dot data d14, d24, d34, . . . as shown in FIG. 13E. The ink chambers $\mathbf{21}_3$, . . . are driven with a drive voltage waveform shown in FIG. 13B, resulting in printed dot data d26, d36, . . . as shown in FIG. 13F. The ink chambers $\mathbf{21}_1$, $\mathbf{21}_4$, . . . are driven with a drive voltage waveform shown in FIG. 13C, resulting in printed dot data d12, d22, d32, . . . as shown in FIG. 13D.

Such control allows corrections when the difference (d−n 3D) is in the range defined by (2). In a similar manner, corrections can be made when the difference is in the range defined by (3). Thus, as is the case with the first embodiment, the second embodiment also allows misalignment in the sub-scanning direction between dot arrangements produced by the heads 1 and 2 to be corrected. That is, the dot misalignment in the sub-scanning direction is minimized, allowing high-resolution printing of good quality.

A third embodiment of the present invention will be described next with reference to FIGS. 14, 15 and 16.

As shown in FIG. 14, ink jet heads 61 and 62 each with a large number of ink chambers are attached to both sides of a substrate 63 with adhesive, thus forming one print head assembly.

The ink jet heads 61 and 62 are provided with ink nozzles $\mathbf{64}_1$ to $\mathbf{64}_{10}$, . . . , $\mathbf{65}_1$ to $\mathbf{65}_9$, . . . each of which is associated with a respective one of the ink chambers. These nozzles are placed in a staggered arrangement for every five nozzles.

That is, in the ink jet head 61, the ink nozzles $\mathbf{64}_1$ to $\mathbf{64}_{10}$ are arranged at regular intervals of pitch 2P in the main scanning direction perpendicular to the direction indicated by an arrow in which a recording medium moves. The ink chambers are divided into five sets each including every fifth chamber. That is, the ink nozzles $\mathbf{64}_1$, $\mathbf{64}_6$, etc. form a first set. The nozzles $\mathbf{64}_2$, $\mathbf{64}_7$, etc. form a second set. The nozzles $\mathbf{64}_3$, $\mathbf{64}_8$, etc. form a third set. The nozzles $\mathbf{64}_4$, $\mathbf{64}_9$, etc. form a fourth set. The nozzles $\mathbf{64}_5$, $\mathbf{64}_{10}$, etc. form a fifth set. The ink nozzles $\mathbf{64}_1$, $\mathbf{64}_6$, etc. in the first set to which reference is made are arranged on a line 1*d*. The ink nozzles $\mathbf{64}_2$, $\mathbf{64}_7$, etc. in the second set are arranged on a line 1*e* which is offset from the line 1*d* by given pitch D in the sub-scanning direction in which the recording medium travels. The ink nozzles $\mathbf{64}_3$, $\mathbf{64}_8$, etc. in the third set are arranged on a line if offset from the line 1*e* by the pitch D in the sub-scanning direction. The ink nozzles $\mathbf{64}_4$, $\mathbf{64}_9$, etc. in the fourth set are arranged on a line 1*g* offset from the line 1*f* by the pitch D in the sub-scanning direction. The ink nozzles $\mathbf{64}_5$, $\mathbf{64}_{10}$, etc. in the fifth set are arranged on a line 1*h* offset from the line 1*g* by the pitch D in the sub-scanning direction.

In the ink jet head 62, each of the nozzles $\mathbf{65}_1$ to $\mathbf{65}_9$, etc., which are arranged at regular intervals of pitch 2P in the main scanning direction, is offset from a corresponding one of the nozzles $\mathbf{64}_1$ to $\mathbf{64}_9$, etc. by pitch P in the main scanning direction. The ink chambers are divided into five sets each including every fifth chamber. That is, the ink nozzles $65_1$, $66_6$, etc. form a first set. The nozzles $65_2$, $65_7$, etc. form a second set. The nozzles $65_3$, $65_8$, etc. form a third set. The nozzles $65_4$, $65_9$, etc. form a fourth set. The nozzles $65_5$, etc. form a fifth set. The ink nozzles $65_1$, $65_6$, etc. in the first set to which reference is made are arranged on a line 2*d* offset from the reference line 1*d* by distance d in the sub-scanning direction. The ink nozzles $65_2$, $65_7$, etc. in the second set are arranged on a line 2*e* offset from the line 2*d* by given pitch D in the sub-scanning direction in which the recording medium travels. The ink nozzles $65_3$, $65_8$, etc. in the third set are arranged on a line 2*f* offset from the line 2*e* by the pitch D in the sub-scanning direction. The ink nozzles $65_4$, $65_9$, etc. in the fourth set are arranged on a line 2*g* offset from the line 2*f* by the pitch D in the sub-scanning direction. The ink nozzles $65_5$, etc. in the fifth set are arranged on a line 2*h* offset from the line 2*g* by the pitch D in the sub-scanning direction. The ink jet heads 61 and 62 are each arranged to provide drive voltage waveforms to their respective ink chambers at the times indicated in FIGS. 15A to 15F, thus performing five-phase driving. That is, the ink nozzles $64_1$, $64_6$, etc. on the line 1*d* of the head 61 and the ink nozzles $65_1$, $65_6$, etc. on the line 2*d* of the head 62 are allowed to project droplets of ink at the times indicated in FIG. 15A. The ink nozzles $64_2$, $64_7$, etc. on the line 1*e* of the head 61 and the ink nozzles $65_2$, $65_7$, etc. on the line 2*e* of the head 62 project droplets of ink at the times indicated in FIG. 15B. The ink nozzles $64_3$, $64_8$, etc. on the line if of the head 61 and the ink nozzles $65_3$, $65_8$, etc. on the line 2*f* of the head 62 project droplets of ink at the times indicated in FIG. 15C. The ink nozzles $64_4$, $64_9$, etc. on the line 1*g* of the head 61 and the ink nozzles $65_4$, $65_9$, etc. on the line 2*g* of the head 62 project droplets of ink at the times indicated in FIG. 15D. The ink nozzles $64_5$, $64_{10}$, etc. on the line 1*h* of the head 61 and the ink nozzles $65_5$, etc. on the line 2*h* of the head 62 project droplets of ink at the times indicated in FIG. 15E.

Thus, when a line of printing is made with the recording head, the ink jet head 61 prints dots n1, n2, n3, n4, . . . as in FIG. 5 trough the three-phase driving and the ink jet head 62 prints dots m1, m2, m3, m4, . . . through the three-phase driving, so that one line can be printed at dot pitch P in the main scanning direction. That is, the ink jet heads 61 and 62, while each having a dot pitch of 2P in the main scanning direction, can make printing at twice the resolution determined by that dot pitch.

If the spacing d between the lines 1*d* and 2*d* of the heads 61 and 62 is set such that $d=n\times 5D$ ($n\geqq 1$), then a dot line printed by the head 61 can be superimposed upon a dot line by the head 62 because the timing of application of the drive voltage waveforms shown in FIGS. 15A to 15E are determined based on the pitch D in the sub-scanning direction. In this case, there is no problem. In practice, however, misalignment will occur between the dot lines printed by the heads 61 and 62 due to irregularities in the thickness of the substrate 63 and/or the adhesive layer.

When the amount of misalignment between the line of dots n1, n2, n3, . . . printed by the head 61 and the line of dots m1, m2, m3, . . . printed by the head 62 is in excess of one-half of the dot pitch in the sub-scanning direction, similar control to that in the above-described embodiments allows the amount of misalignment to be reduced below one-half of the dot pitch in the sub-scanning direction.

In this embodiment, since one dot pitch in the sub-scanning direction is further subdivided the accuracy of printing position can be increased in comparison with the above-described embodiments in which the ink nozzles are staggered for every three nozzles. However, in the five-phase driving for one line of printing, the printing speed becomes slower than in the three-phase driving.

Thus, the choice of the three-phase driving or the five-phase driving depends on tradeoff between the printing speed and the accuracy of printing position.

Next, a fourth embodiment of the present invention will be described with reference to FIGS. 17, 18 and 19.

In FIG. 17, 71, 72 and 73 denote ink jet heads for projecting cyan ink, magenta ink, and yellow ink, respectively. The cyan ink jet head 71 and the magenta ink jet head 72 are attached to both sides of a substrate 74 with adhesive, and the magenta ink jet head 72 and the yellow ink jet head 73 are attached to both sides of a substrate 75 with adhesive, thereby forming one color print head assembly.

Figure 18:
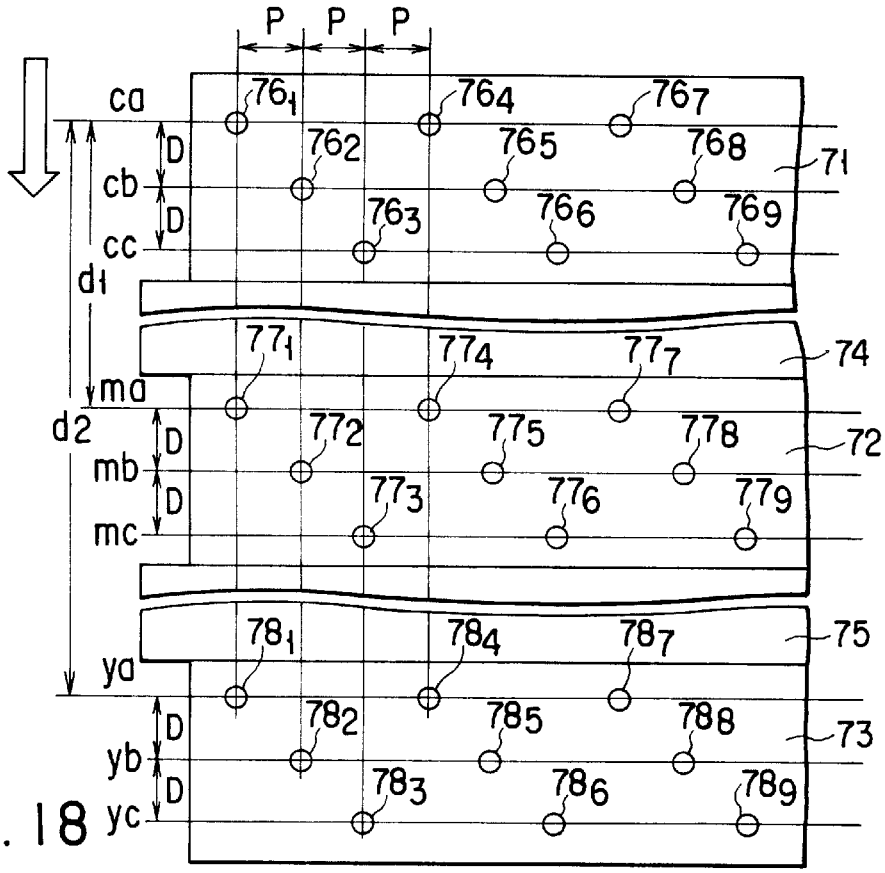
FIG. 18 shows an arrangement of ink nozzles of each ink jet head in the fourth embodiment of the present invention.

As shown in FIG. 18, the ink jet heads 71, 72 and 73 are formed with ink nozzles $76_1$ to $76_9$, . . . , $77_1$ to $77_9$, . . . , and $78_1$ to $78_9$, . . . each of which is associated with a respective one of ink chambers. These ink nozzles are placed in a staggered arrangement for every three nozzles. That is, the ink nozzles $76_1$ to $76_9$, . . . of the ink jet head 71 are arranged at regular intervals of pitch P in the main scanning direction perpendicular to the direction of movement of the recording medium indicated by an arrow.

In the ink jet head 71, the ink chambers are divided into three sets each including every third head. That is, the ink nozzles $76_1$, $76_4$, $76_7$, etc. form a first set. The nozzles $76_2$, $76_5$, $76_8$, etc. form a second set, and the nozzles $76_3$, $76_6$, $76_9$, etc. form a third set. The ink nozzles $76_1$, $76_4$, $76_7$, etc. in the first set to which reference is made are arranged on a line ca. The ink nozzles $76_2$, $76_5$, $76_8$, etc. in the second set are arranged on a line cb which is offset from the line ca by given pitch D in the sub-scanning direction. The ink nozzles $76_3$, $76_6$, $76_9$, etc. in the third set are arranged on a line cc which is offset from the line cb by the pitch D in the sub-scanning direction.

In the ink jet head 72 as well, the ink chambers are divided into three sets each including every third head. That is, the ink nozzles $77_1$, $77_4$, $77_7$, etc. form a first set. The nozzles $77_2$, $77_5$, $77_8$, etc. form a second set, and the nozzles $77_3$, $77_6$, $77_9$, etc. form a third set.

In the ink jet head 73, each of the nozzles $78_1$ to $78_9$, etc., which are arranged at regular intervals of pitch P in the main scanning direction, is aligned with a corresponding one of the nozzles $76_1$ to $76_9$, etc. in the head 71 in the sub-scanning direction. The ink nozzles $78_1$, $78_4$, $78_7$, etc. in the first set are arranged on a line ya which is spaced apart from the reference line ca by distance d2 in the sub-scanning direction. The ink nozzles $78_2$, $78_5$, $78_8$, etc. in the second set are arranged on a line yb offset from the line ya by given pitch D in the sub-scanning direction. The ink nozzles $78_3$, $78_6$, $78_9$, etc. in the third set are arranged on a line yc offset from the line yb by the pitch D in the sub-scanning direction.

The ink jet heads 71, 72 and 73 are each arranged to provide drive voltage waveforms to their respective ink chambers at the times indicated in FIGS. 4A, 4B and 4C as in the first embodiment, thus performing three-phase driving. That is, the ink nozzles $76_1$, $76_4$, $76_7$, etc. on the line ca of the head 71, the ink nozzles $77_1$, $77_4$, $77_7$, etc. on the line ma of the head 72 and the ink nozzles $78_1$, $78_4$, $78_7$, etc. on the line ya of the head 73 project ink at the times indicated in FIG. 4A. The ink nozzles $76_2$, $76_5$, $76_8$, etc. on the line cb of the head 71, the ink nozzles $77_1$, $77_4$, $77_7$, etc. on the line mb of the head 72 and the ink nozzles $78_2$, $78_5$, $78_8$, etc. on the line yb of the head 73 project ink at the times indicated in FIG. 4B. The ink nozzles $76_3$, $76_6$, $76_9$, etc. on the line cc of the head 71, the ink nozzles $77_3$, $77_6$, $77_9$, etc. on the line mc of the head 72 and the ink nozzles $78_3$, $78_6$, $78_9$, etc. on the line yc of the head 73 project ink at the times indicated in FIG. 4C.

For printing one line using the head assembly thus arranged, the ink jet head 71 is first three-phase driven to print dots, the head 72 is then three-phase driven to print selectively dots on the printed dots by the head 71, and the head 73 is finally three-phase driven to print selectively dots on the printed dots by the heads 71 and 72. Thus, color printing is made by printing three colored dots of cyan, magenta, and yellow independently or superimposed upon each other.

Figure 19A:
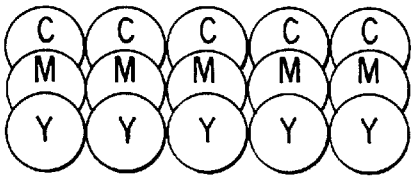
FIGS. 19A and 19B show printed dots in the third embodiment before and after correction of dot alignment error.

If the spacing d1 between the line ca of the cyan head 71 and the line ma of the magenta head 72 is set such that d1=n 3D (n≧1) and the spacing d2 between the line ca of the cyan head 71 and the line ya of the yellow head 73 is set such that d2=n' 3D (n'≧1), then the printed dots by the heads 72 and 73 can be superimposed accurately upon the printed dots by the head 71 because the timing of application of the drive voltage waveforms shown in FIGS. 4A, 4B and 4C is determined based on the pitch D in the sub-scanning direction. In this case, there is no problem. In the presence of irregularities in the thickness of the substrates 74 and 75 and/or the adhesive layer, however, misalignment will occur among the cyan dots, the magenta dots, and the yellow dots. That is, such misalignment of dots as shown in FIG. 19A is produced.

The misalignment of dots is measured in the same way as that of the first embodiment described in connection with FIGS. 9A and 9B.

Figure 19B:
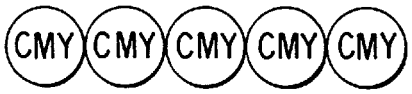

In such a case, as with the first embodiment, the position of each dot in the sub-scanning direction is adjusted and the dot misalignment is minimized by varying the order allocated for the lines of the head 72 and/or head 73 to project ink. As a result, the cyan, magenta and yellows dots can become superimposed accurately as shown in FIG. 19B, achieving color printing of good quality.

Hereinafter, a fifth embodiment of the present invention will be described with reference to FIGS. 20 and 21.

Figure 20:
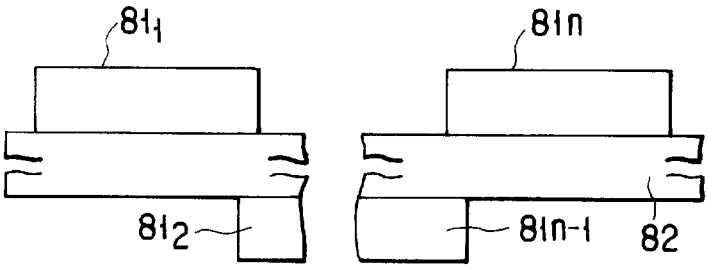
FIG. 20 is a schematic representation of a print head assembly according to a fifth embodiment of the present invention.
Figure 21:
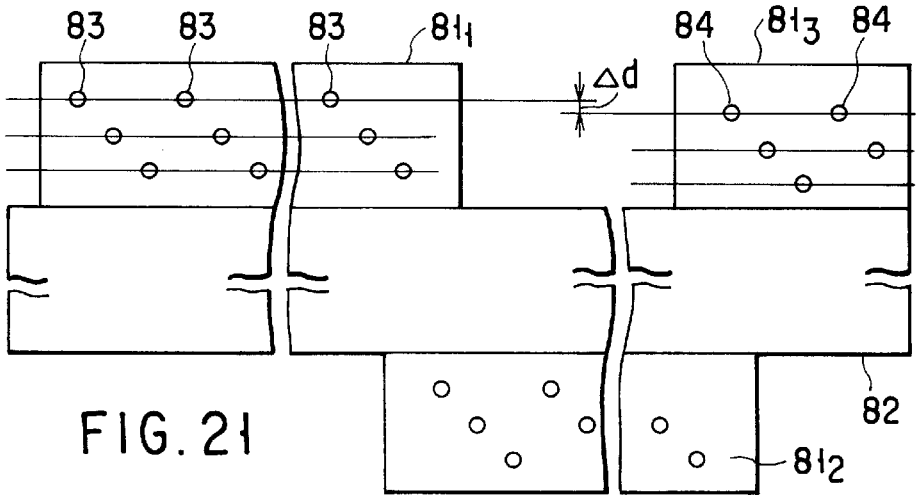
FIG. 21 shows an arrangement of ink nozzles of each ink jet head in the fifth embodiment.

As shown in FIG. 20, n ink jet heads $\mathbf{81}_1$ to 81*n* each having a large number of ink chambers arranged are staggered on either side of a substrate 82 to form an elongate line print head assembly. This line print head assembly is placed so that its longitudinal line coincides with the main scanning direction perpendicular to the direction in which a recording medium moves and makes printing onto the recording medium on a line by line basis.

In each of the ink jet heads $\mathbf{81}_1$ to 81*n* of the line print head assembly, as in the ink jet heads 1 and 2 in the first embodiment, the ink nozzles are staggered for every three nozzles and the ink chambers are divided into three sets each including every third chamber. In such a line print head, as shown in FIG. 21, each of lines of ink nozzles 83 in the head $\mathbf{81}_1$ and the corresponding line of ink nozzles 84 of the head $\mathbf{81}_3$ placed on the same side as the head 81 may be offset from each other by Δd in the sub-scanning direction.

In such a case, the line offset can be corrected by making the timing of projecting of ink from each set of ink nozzles in the head $\mathbf{81}_3$ differ from the timing of projecting of ink from the corresponding set of ink nozzles in the head $\mathbf{81}_1$. That is, as described previously in the first embodiment, the position offset in the sub-scanning direction is corrected by changing the order in which the drive voltage waveforms shown in FIGS. 4A, 4B and 4C are selected, i.e., by changing the timing of ink projection. The position offset in the sub-scanning direction of the ink nozzles of the heads $\mathbf{81}_1$ and $\mathbf{81}_2$ that are placed on the opposed surfaces of the substrate 82 can be corrected through exactly the same control as in the first embodiment.

A sixth embodiment of the present invention will be described next with reference to FIGS. 22 and 23.

Figure 22:
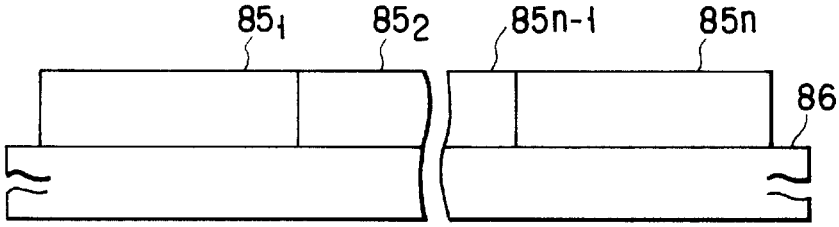
FIG. 22 is a schematic representation of a print head assembly according to a sixth embodiment of the present invention.
Figure 23:
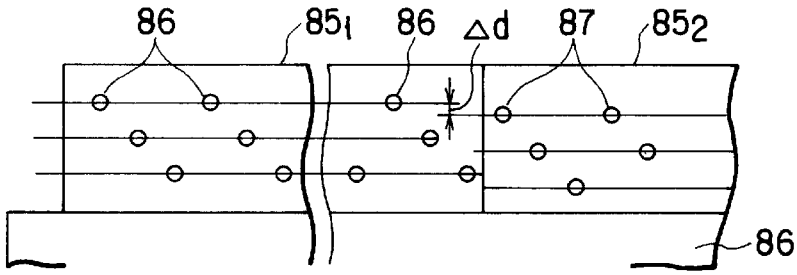
FIG. 23 shows an arrangement of ink nozzles of each ink jet head in the sixth embodiment.

As shown in FIG. 22, n ink jet heads $\mathbf{85}_1$ to 85*n* each equipped with a large number of ink chambers are arranged side by side on the same side of a substrate 86 and fixed to the substrate with adhesive, thereby forming an elongate line print head assembly. This line print head assembly is placed so that its longitudinal line coincides with the main scanning direction perpendicular to the direction in which a recording medium moves and makes printing onto the recording medium on a line by line basis.

In each of the ink jet heads $\mathbf{85}_1$ to 85*n* of the line print head assembly, as in the ink jet heads 1 and 2 in the first embodiment, the ink nozzles are staggered for every three nozzles and the ink chambers are divided into three sets each including every third chamber. In such a line print head, as shown in FIG. 23, each of lines of ink nozzles 86 in the head $\mathbf{85}_1$ and the corresponding line of ink nozzles 87 of the head $\mathbf{85}_2$ may be offset from each other by Δd in the sub-scanning direction.

In such a case, the line offset can be corrected by making the timing of projecting of ink from each set of ink nozzles in the head $\mathbf{85}_2$ differ from the timing of projecting of ink from the corresponding set of ink nozzles in the head $\mathbf{85}_1$. That is, as described previously in the first embodiment, the position offset in the sub-scanning direction is corrected by changing the order in which the drive voltage waveforms shown in FIGS. 4A, 4B and 4C are selected, i.e., by changing the timing of ink projection.

A seventh embodiment of the present invention will be described next with reference to FIG. 24.

Figure 24:
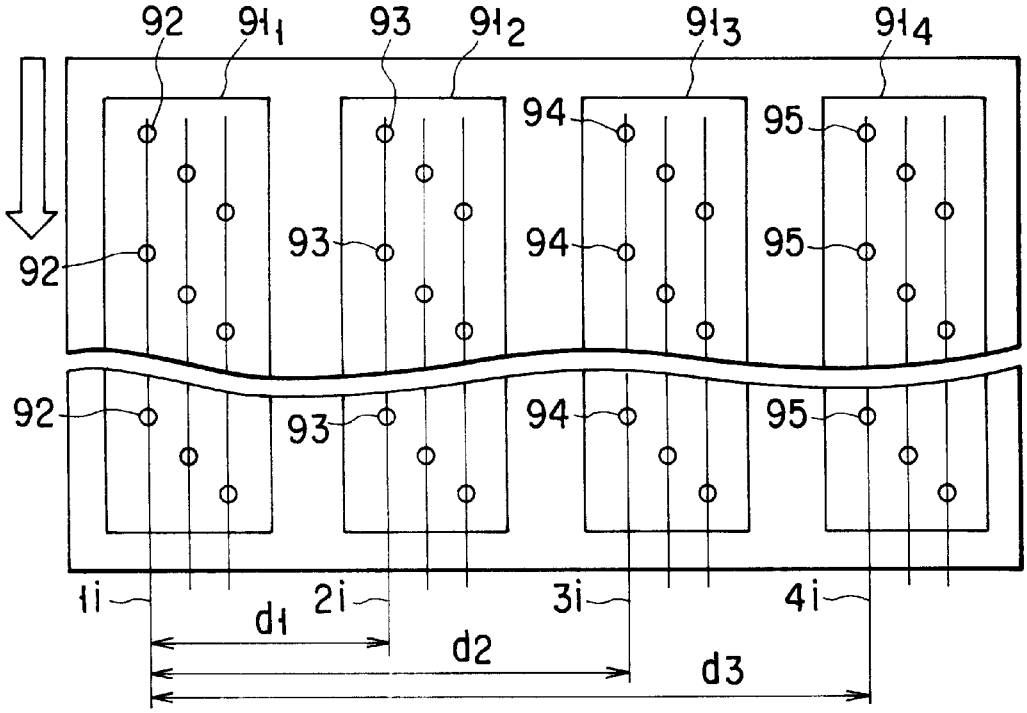
FIG. 24 is a schematic representation of a print head assembly according to a seventh embodiment of the present invention.

As shown in FIG. 24, for example, four ink jet heads $\mathbf{91}_1$, $\mathbf{91}_2$, $\mathbf{91}_3$, $\mathbf{91}_4$, each equipped with a large number of ink chambers, are arranged such that they are in parallel with each other in the direction indicated by an arrow in which a recording medium moves, i.e., in the sub-scanning direction and are spaced apart from each other by predetermined distance in the main scanning direction perpendicular to the direction in which the recording medium moves, thereby forming a serial print head assembly.

In each of the ink jet heads $\mathbf{91}_1$ to $\mathbf{91}_4$ of the serial print head assembly, the ink nozzles are staggered for every three nozzles and the ink chambers are divided into three sets each including every third chamber. When reference is made to a line 1*i* on which a first set of ink nozzles 92 in the leftmost head $\mathbf{91}_1$ are arranged, a line 2*i* on which a first set of ink nozzles 93 of the head $\mathbf{91}_2$ are arranged is spaced apart by distance d1 from the line l*i*. A line 3*i* on which a first set of ink nozzles 94 of the head $\mathbf{91}_3$ are arranged is spaced apart by distance d2 from the line 1*i*. A line 4*i* on which a first set of ink nozzles 95 of the head $\mathbf{91}_4$ are arranged is offset by distance d3 from the line 1*i*.

This type of serial print head assembly is arranged to move in the main scanning direction with a recording medium stopped to thereby print multiple lines of dots at a time.

The print head assembly forms a color serial print head when the heads $\mathbf{91}_1$, $\mathbf{91}_2$, $\mathbf{91}_3$, $\mathbf{91}_4$, are used as heads for cyan, magenta, yellow, and black, respectively.

When dots printed by the heads $\mathbf{91}_1$, $\mathbf{91}_2$ and $\mathbf{91}_3$ are out of register in the main scanning direction, the order in which the drive voltage waveforms shown in FIGS. 4A, 4B and 4C are selected can be changed as in the first embodiment, i.e., the timing of ink projection from the ink nozzles can be changed for each set of ink nozzles in the heads $\mathbf{91}_1$, $\mathbf{91}_2$ and $\mathbf{91}_3$ to correct the registration error of dots in the main scanning direction.

Next, detailed configurations of the ink jet heads in the embodiments thus far described will be described.

Figure 25A:
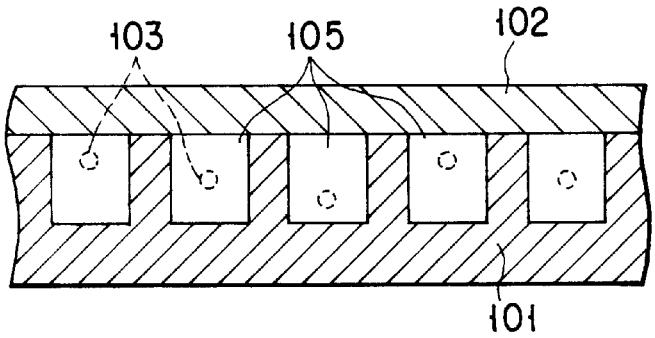
FIGS. 25A and 25B show a configuration of the ink jet head used in each of the embodiments of the present invention.
Figure 25B:
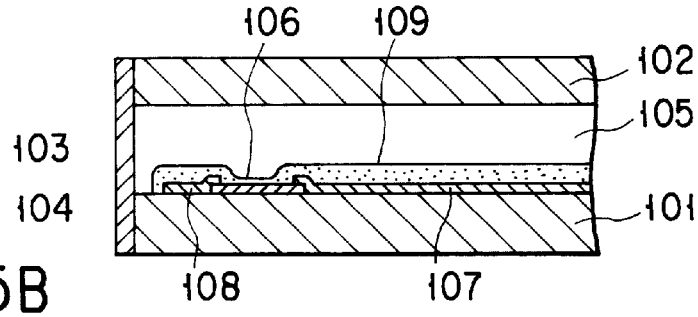

FIGS. 25A and 25B show an ink jet head of the type that heats ink in the ink chambers and then projects it. Grooves of U-shaped cross section are formed in one surface of a substrate 101 at predetermined pitch. The grooves are covered on top with a board 102 and covered in front with an orifice plate 104 formed with ink nozzles 103, thus forming a large number of ink chambers 105. Within each ink chamber are formed a heating element 106 and electrode patterns 107 and 108 for energizing the heating element, which, in turn, are covered with a protective coating 109.

In this type of ink jet head, application of a drive pulse to the heating element 106 through the electrode patterns 107 and 108 rapidly heats ink within the ink chamber, so that it boils and forms a bubble of vapor, thus allowing a droplet of ink to be ejected from the ink nozzle.

Constructing a line print head from such ink jet heads would require a considerable amount of electric power when a large number of heating elements are driven at the same time, resulting in an increase in the size of a power supply used. The time-division driving of the ink chambers reduces the number of heating elements that are driven at the same time, allowing the supply amount of electric power to be reduced and hence the size of power supply to be reduced. If, when such time-division driving is performed, the ink jet heads are configured and controlled as in the previously described embodiments, the alignment error of dots can be corrected. This is the case with the time-division driving of a serial print head.

Figure 26A:
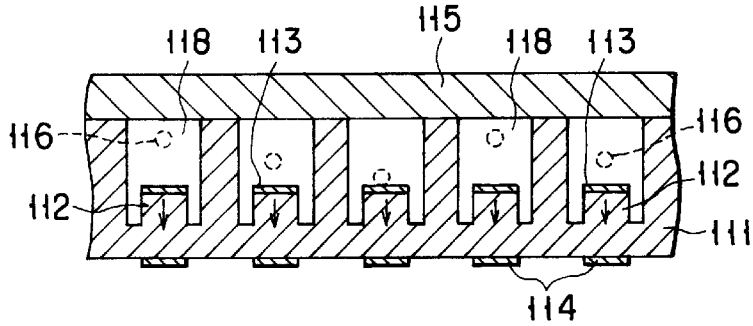
FIGS. 26A and 26B show another configuration of the ink jet head used in each of the embodiments of the present invention.
Figure 26B:
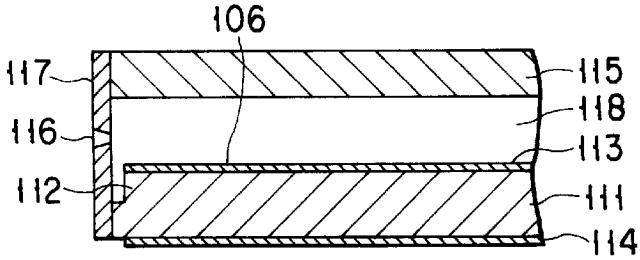

FIGS. 26A and 26B show an ink jet head of the type that ejects ink within ink chambers by mechanical vibrations of a piezoelectric material. Grooves of U-shaped cross section are formed in one surface of a substrate 111 made of a piezoelectric material, when an actuator that is polarized in the direction of an arrow is formed in the middle of each groove. Electrode patterns 113 and 114 are formed on the opposed surfaces of the actuator. The grooves are covered on top with a board 115 and covered in front with an orifice plate 117 formed with ink nozzles 116, thus forming a large number of ink chambers 118.

With this type of ink jet head, application of a drive pulse between the electrode patterns 113 and 114 causes mechanical deformation in the actuator 112, resulting in a change in the volume of the ink chamber. A change in the volume of the ink chamber involves a change in pressure in the ink chamber, allowing ink to be ejected from the nozzle.

Constructing a line print head or a serial print head from such ink jet heads and driving ink chambers on a time-division basis allow alignment error of dots to be corrected as in the previously described embodiments.

Figure 27A:
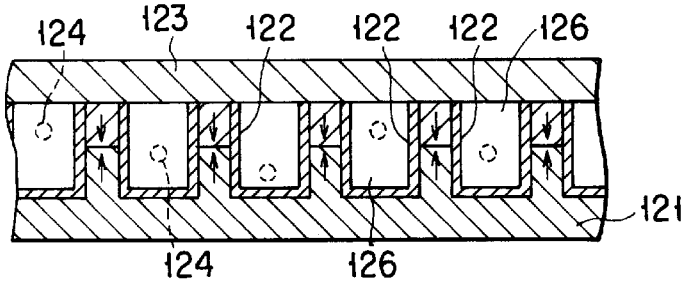
FIGS. 27A and 27B show still another configuration of the ink jet head used in each of the embodiments of the present invention.
Figure 27B:
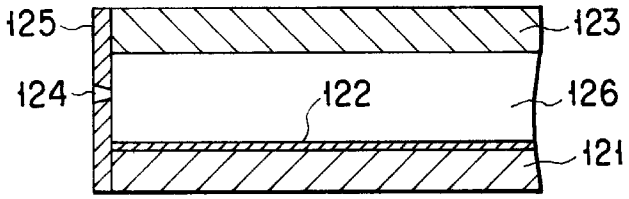

FIGS. 27A and 27B show an ink jet head of the type that ejects ink by mechanical vibrations of piezoelectric elements. Two polarized piezoelectric elements are glued together with their directions of polarization opposed to each other to form a substrate 121. U-shaped grooves are formed at predetermined pitch in one surface of the substrate across the two piezoelectric elements. An electrode pattern 122 is formed on the sidewalls and the bottom of each groove. The grooves are covered on top with a board 123 and covered in front with an orifice plate 125 formed with ink nozzles 124, thus forming a large number of ink chambers 126.

With this type of ink jet head, application of a drive pulse between the electrode pattern 122 of an ink chamber (center ink chamber) and the electrode pattern 122 of each of two ink chambers 126 on both sides of that ink chamber causes mechanical deformation in substrate portions between the two ink chambers, resulting in a change in pressure of the center ink chamber from which ink is to be ejected. The change in pressure allows ink to be ejected from the ink nozzle 124 associated with the center ink chamber.

With this type of ink jet head, since substrate portions each between an ink ejecting chamber and an adjacent ink chamber are deformed, it follows that the ink chambers are driven on a time-division basis. Configuring and controlling this type of ink jet head in the manner described in connection with each of the embodiments allows alignment errors of dots to be corrected.

Although the preferred embodiments of the present invention have been described in terms of ink jet heads, the present invention is also applicable to thermal heads.

Figure 28:
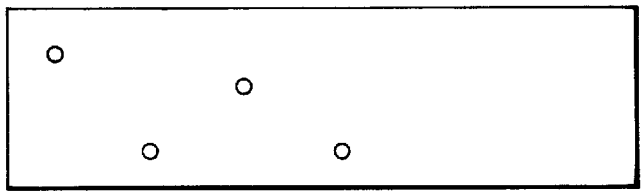
FIG. 28 shows another example of a staggered arrangement of ink nozzles.

The previously described staggered arrangements of ink nozzles may include such an arrangement as shown in FIG. 28.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A recording apparatus comprising:

ink jet heads each comprising N sets of ink nozzles, each of the N sets comprising N ink nozzles arranged at a predetermined pitch in a main scanning direction, with the N sets also being arranged in N rows at a predetermined pitch D in a sub-scanning direction;

an ink jet head unit including at least two of said ink jet heads provided on a substrate such that said ink jet heads are provided on a same side of the substrate or are separated from each other by a predetermined distance;

driving means for driving the ink nozzles of said ink jet heads, said driving means including setting means for setting an order in which the N sets of ink nozzles are driven;

carry controlling means for carrying a recording medium in a direction perpendicular to a longitudinal direction of the ink jet head unit, said carry controlling means controlling printing of the N sets of ink nozzles such that printing is performed on a same line on the recording medium in the main scanning direction; and printing order changing means for changing-an order in which the N sets of ink nozzles perform printing, to thereby correct a printing position error which is caused by an error in positions of the ink jet heads in the sub-scanning direction at a spacing which is outside of a range from −D/6 to D/6 in the sub-scanning direction;

wherein respective ones of the ink jet heads are arranged at different positions in the sub-scanning direction, and corresponding ink nozzles in the ink jet heads arranged in different positions in the sub-scanning direction are offset from each other in the main scanning direction.

2. The recording apparatus according to claim 1, wherein respective ones of the ink jet heads that are arranged at different positions in the sub-scanning direction are for printing a respective one of yellow, cyan, and magenta for color printing.

3. The recording apparatus according to claim 1, wherein the ink nozzles of each of said ink jet heads are placed side by side on the same side of the substrate.

4. The recording apparatus according to claim 1, wherein the ink jet heads are placed on the same side of the substrate.

5. The recording apparatus according to claim 1, wherein when the error in positions of the recording heads in the sub-scanning direction falls within a range from D/6 to D/2, the printing order changing means changes the order in which the N sets of recording elements perform printing according to a first correcting method.

6. The recording apparatus according to claim 5, wherein when the error in positions of the recording heads in the sub-scanning direction falls within a range from D/2 to 5D/6, the printing order changing means changes the order in which the N sets of recording elements perform printing according to a second correcting method.

7. A recording apparatus comprising:

recording heads each comprising N sets of recording elements, each of the N sets comprising N recording elements arranged at a predetermined pitch in a main scanning direction, with the N sets also being arranged in N rows at a predetermined pitch D in a sub-scanning direction;

a print head unit including at least two of said recording heads provided on the substrate such that said recording heads are provided on a same side of the substrate or are separated from each other by a predetermined distance;

driving means for driving the recording elements of said recording heads, said driving means including setting means for setting an order in which the N sets of recording elements are driven;

carry controlling means for carrying a recording medium in a direction perpendicular to a longitudinal direction of the print head unit, said carry controlling means controlling printing of the N sets of recording elements such that printing is performed on a same line on the recording medium in the main scanning direction; and printing order changing means for changing an order in which the N sets of recording elements perform printing, to thereby correct a printing position error which is caused by an error in positions of the recording heads in the sub-scanning direction at a spacing which is outside of a range from −D/6 to D/6 in the sub-scanning direction;

wherein when the error in positions of the recording heads in the sub-scanning direction falls within a range from D/6 to D/2, the printing order changing means changes the order in which the N sets of recording elements perform printing according to a first correcting method.

8. The recording apparatus according to claim 7, wherein when the error in positions of the recording heads in the sub-scanning direction falls within a range from D/2 to 5D/6, the printing order changing means changes the order in which the N sets of recording elements perform printing according to a second correcting method.

9. A method of driving a plurality of recording heads which are provided on a substrate to form a print head unit, wherein each of the recording heads comprises N sets of recording elements each comprising N recording elements arranged at a predetermined pitch in a main scanning direction, wherein said recording heads are provided on a same side of the substrate or are separated from each other by a predetermined distance, and wherein the N sets of recording element are also arranged at a predetermined pitch D in the sub-scanning direction, said method comprising the steps of:

controlling printing of the N sets of recording element sets such that printing is performed on a same line in the main scanning direction; and changing an order in which the N sets of recording elements perform the printing, to thereby correct a printing position error which is caused by an error in positions of the recording heads in the sub-scanning direction at a spacing which is outside of a range from −D/6 to D/6 in the sub-scanning direction;

wherein when the error in positions of the recording heads in the sub-scanning direction falls within a range from D/6 to D/2, the order in which the N sets of recording elements perform printing is changed according to a first correcting method.

10. The method according to claim 9, wherein when the error in positions of the recording heads in the sub-scanning direction falls within a range from D/2 to 5D/6, the order in which the N sets of recording elements perform printing is changed according to a first correcting method.

* * * * *